US006170417B1

(12) United States Patent
Kinoshita et al.

(10) Patent No.: US 6,170,417 B1
(45) Date of Patent: Jan. 9, 2001

(54) REMOTE CONTROL BOBBIN CASE EXCHANGER DEVICE

(75) Inventors: Haruhiko Kinoshita, Nagoya; Sei Kato, 502, Takabari 5-chome, Meito-ku, Nagoya-shi, Aichi 465-0061, both of (JP)

(73) Assignees: Kinoshita Precision Industrial; Sei Kato, both of Nagoya (JP)

( * ) Notice: Under 35 U.S.C. 154(b), the term of this patent shall be extended for 0 days.

(21) Appl. No.: 09/509,890

(22) PCT Filed: May 21, 1998

(86) PCT No.: PCT/JP98/02255

§ 371 Date: Apr. 3, 2000

§ 102(e) Date: Apr. 3, 2000

(87) PCT Pub. No.: WO99/18277

PCT Pub. Date: Apr. 15, 1999

(30) Foreign Application Priority Data

Oct. 6, 1997 (JP) ..... 9-272912

(51) Int. Cl.[7] ..... D05B 59/04

(52) U.S. Cl. ..... 112/470.01; 112/180; 112/186; 242/473.5

(58) Field of Search ..... 112/470.01, 470.05, 112/180, 186, 279; 242/473.5, 473.6, 473.8

(56) References Cited

U.S. PATENT DOCUMENTS 5,718,181 * 2/1998 Shinozuka et al. ..... 112/186
6,041,725 * 3/2000 Resta ..... 112/470.05

FOREIGN PATENT DOCUMENTS 4-61891 2/1992 (JP) .
7-275552 10/1995 (JP) .
7-308478 11/1995 (JP) .
8-196766 8/1996 (JP) .
8-280972 10/1996 (JP) .
9-66181 3/1997 (JP) .

OTHER PUBLICATIONS

English Translation of IPE Report PCT/PIPEA/409 Mar. 15, 1999.*

* cited by examiner

*Primary Examiner*—Peter Nerbun
(74) *Attorney, Agent, or Firm*—Morgan, Lewis & Bockius LLP

(57) ABSTRACT

In a remote control bobbin case exchanger device (1), a rotary bobbin (K) is to be placed in a position that is not easily accessed, and an exchangeable position (α) is provided in a position that is readily accessed in a bobbin case providing member (3). A chuck driving member (6) moves a chuck member (5) toward the rotary bobbin (K) to clutch a bobbin case (2) along a line connecting the rotary bobbin (K) to the exchangeable position (α). With the action of the chuck driving member (6) and the chuck member (5), it is possible to remove the bobbin case (2) from an inaccessible rotary bobbin (K) to replace the bobbin case (2) with a new one in the exchangeable position (α)

4 Claims, 3 Drawing Sheets

REMOTE CONTROL BOBBIN CASE EXCHANGER DEVICE

FIELD OF THE INVENTION

The present invention relates to a remote control bobbin case exchanger device well-suited for a sewing machine in which a rotary bobbin is placed inaccessibly, and particularly concerns a remote control bobbin case exchanger device better-suited for an industrial sewing machine in which a plurality of embroideries are wrought out concurrently.

DESCRIPTION OF PRIOR ART

In a sewing machine in which a bobbin case is provided within a rotary bobbin so as to supply an under thread, an amount of the under thread wound to the bobbin is very small compared to that of an upper thread. This necessitates to frequently set and remove bobbin cases so as to replace the bobbins.

Take for example an industrial sewing machine. In such a machine it is often difficult to access where a rotary bobbin is placed. This makes it cumbersome and time-consuming to exchange the bobbin cases. This becomes one of the factors to reduce efficiency with a deteriorated workability particularly in the industrial sewing machine in which the bobbin cases are to be frequently exchanged.

This is all the more true especially in an industrial embroidery sewing machine in which a plurality of embroideries are concurrently wrought out necessitating the exchange of a significant number of the bobbin cases (e.g., 6~15) at the same time. When the rotary bobbin is placed inaccessibly, it takes a long time to exchange the bobbin cases, thereby substantially reducing a sewing workability upon replacing the bobbin cases.

Therefore, the present invention was made with the above drawbacks in mind. It is a main object of the invention to provide a remote control bobbin case exchanger device which is capable of readily exchanging bobbin cases under the circumstances in which a rotary bobbin is placed inaccessibly.

DISCLOSURE OF THE INVENTION

The present invention adopts the following means.

[1] A remote control bobbin case exchanger device comprising:

(a) a bobbin case providing member placed remote from a rotary bobbin of a sewing machine so as to provide a bobbin case in an exchangeable position;

(b) a chuck member provided to exchange the bobbin case (c) a chuck driving member provided to transfer the chuck member toward the rotary bobbin and the exchangeable position;

(d) the chuck driving member including;

(i) a cam plate having a cammed groove directed to the rotary bobbin and having a regulation groove provided along the cammed groove and determined over its trajectory so as to be shorter than the cammed groove;

(ii) a neck transfer body having a regulation slider rotationally supported around a regulation axis which is movably provided along the regulation groove, and a follower slider having a movement axis slidably provided against the regulation slider within a predetermined range to move along the cammed groove; and (iii) a movement axis driving member provided to reciprocally drive the movement axis along the cammed groove.

[2] According to another aspect of the invention, the movement axis driving member comprises;

a slider bar provided in parallel with the cam plate;

a drive slider movably provided along the slider bar to interfit the movement axis via a drive escape groove oriented in the same direction in which the cammed groove develops; and a chuck transferal actuator provided to reciprocally move the drive slider along the slider bar.

[3] According to yet another aspect of the invention, the chuck transferal actuator comprises a combination of;

a long range air cylinder provided to travel the drive slider in an extended distance; and a short range air cylinder provided to travel the drive slider in a shorter distance.

[4] According to still another aspect of the invention, the bobbin case providing member comprises a case mounting member, an outside of which has a plurality of bobbin cases removably mounted thereon; and a rotary drive member provided to rotationally drive the case mounting member.

[Operation]

With an actuation of the movement axis driving member, the movement axis moves along the cammed groove. With the movement of the movement axis, the follower slider moves along the cammed groove.

In combination with the movement of the follower slider, the regulation slider moves in which the regulation axis interfits the regulation groove.

For the reason that the regulation groove is shorter than the cammed groove, the neck transfer body rotationally moves around the regulation axis to send the chuck member toward the rotary bobbin when the movement axis moves toward the rotary bobbin, and the neck transfer body rotationally moves around the regulation axis to send the chuck member toward the exchangeable position when the movement axis moves toward the exchangeable position.

In this way, when the movement axis drive member moves the movement axis along the cammed groove, the chuck member moves toward the rotary bobbin and the exchangeable position alternately with the assist of the follower slider.

Subsequent to the action of the movement axis drive member, the bobbin case within the rotary bobbin is replaced with another bobbin case.

[Removal of Bobbin Case]

With the movement axis actuated by the movement axis drive member, the chuck member moves toward the rotary bobbin so that the chuck member holds the bobbin case within the rotary bobbin.

Then, the movement axis moves the chuck member toward the exchangeable position. The bobbin case which the chuck member holds may be released or return to a free space within the exchangeable position during which the chuck member reaches the exchangeable position after the bobbin case is removed from the rotary bobbin.

It is to be noted that the bobbin case which the chuck member holds returns to the free space within the exchangeable position, and a replacement bobbin case is subsequently supplied by the bobbin case providing member.

[How the Bobbin Case is Exchanged]

With the chuck member sent to the exchangeable position by the movement axis, it is possible for the chuck member to hold the bobbin case introduced in the exchangeable position.

With the action of the movement axis, it is possible to move the chuck member toward the rotary bobbin so as to set the bobbin case in the rotary bobbin, and thereafter release the replacement bobbin case from the chuck member.

With the use of the remote control bobbin case exchanger device, it is possible to readily exchange the bobbin case by a new one because the bobbin case providing member is placed in the accessible position ha under the circumstances in which the rotary bobbin is inaccessibley placed. This reduces the burdens to which the sewing workers owe, and significantly mitigate the time required to exchange the under thread with an ameliorated workability.

This is all the more true especially in the industrial sewing machine in which a plurality of sewings (e.g., embroideries) are concurrently wrought out. By mounting the remote control bobbin case exchanger devices on the respective rotary bobbins, it is possible to exchange the plurality of the bobbin cases simultaneously, and thereby substantially ameliorating a sewing workability upon exchanging the bobbin cases.

BRIEF DESCRIPTION OF THE DRAWINGS

Preferred forms of the present invention are illustrated in the accompanying drawings in which.

DESCRIPTION OF THE NUMERALS

1—remote control bobbin case exchanger device
2—bobbin case
3—bobbin case providing member
5—chuck member
6—chuck driving member
7—rotary axis (rotary drive member)
9—case mounting member
10—rotary drive device (rotary drive member)
20—cam plate
21—neck transfer body
22—movement axis drive member
23—cammed groove
24—regulation groove
25—regulation axis
26—regulation slider
28—follower slider
29—movement axis
30—slider bar
31—drive slider
31*a*—drive escape groove
32—chuck transferal actuator
32*a*—long range air cylinder
32*b*—short range air cylinder
K—rotary bobbin
M—sewing machine
α—exchangeable position

BEST MODE FOR CARRYING OUT THE INVENTION

A best mode of an embodiment upon carrying out the invention is described below.

[Structure of Embodiment]

Figure 1:
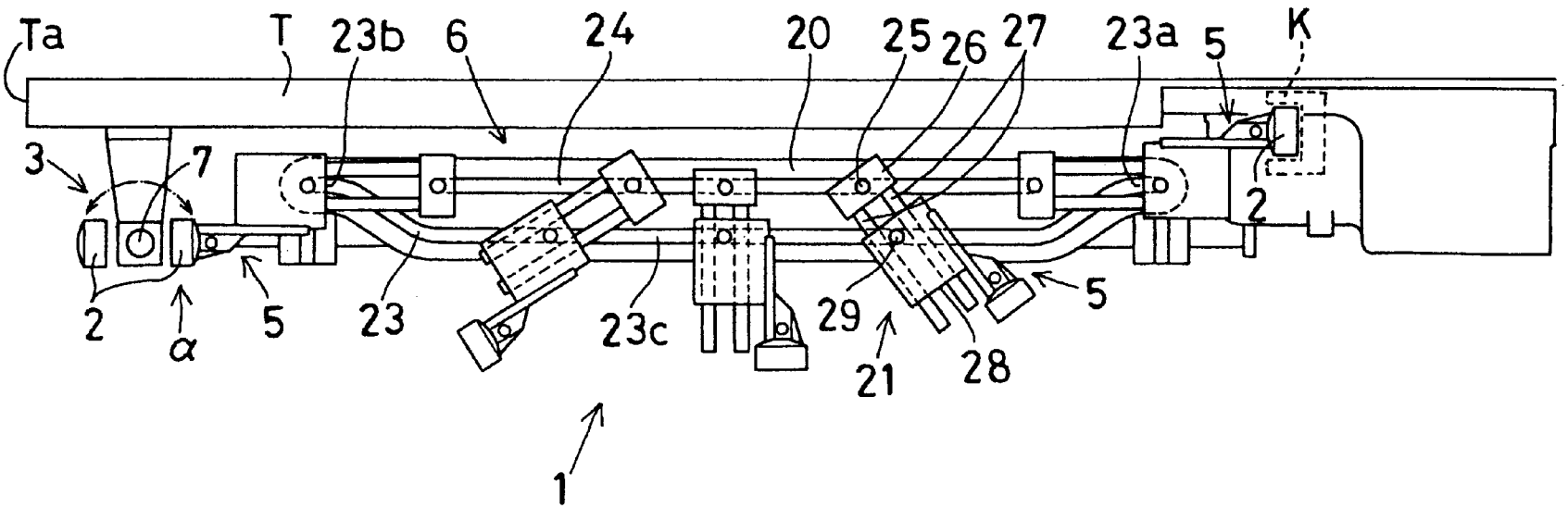
FIG. 1 is a side elevational view of a remote control bobbin case exchanger device according to an embodiment of the invention.
Figure 2:
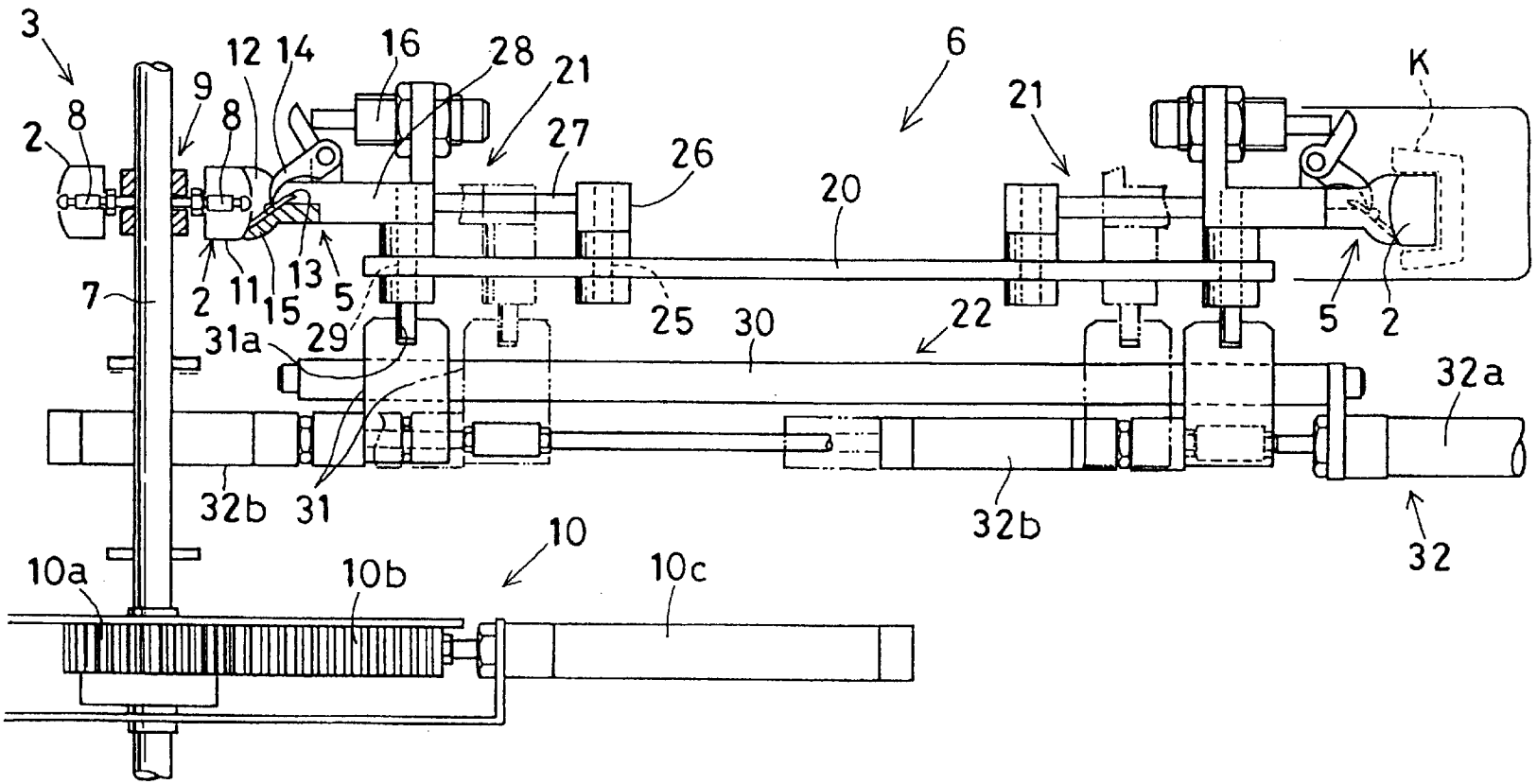
FIG. 2 is a bottom view of the remote control bobbin case exchanger device.
Figure 3:
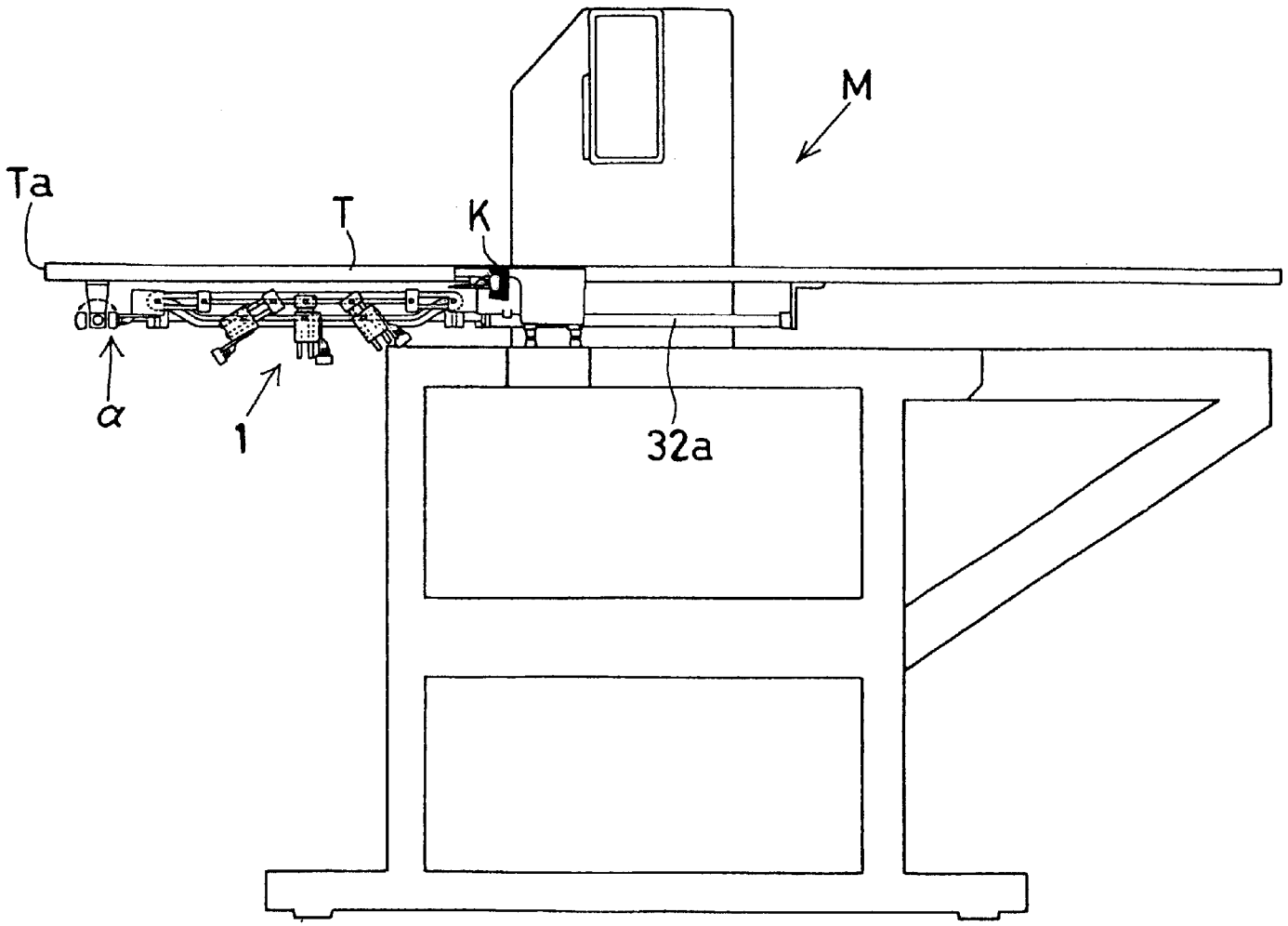
FIG. 3 is a schematic side elevational view of an industrial embroidery sewing machine.

Referring to FIGS. 1~3 which schematically shows a remote control bobbin case exchanger device 1 according to an embodiment of the present invention, the bobbin case exchanger device 1 is incorporated into an industrial embroidery sewing machine (M) in which a plurality of embroideries are concurrently wrought out. Placed behind a periphery end (Ta) of the sewing table (T), is a rotary bobbin (K) which is generally placed in a difficult position for sewing workers to access.

The remote control bobbin case exchanger device 1 has a bobbin case providing member 3 which supplies a replacement bobbin case 2 to an exchangeable position (α). A chuck member 5 is provided to clutch the bobbin case 2 upon exchanging the bobbin cases. A chuck driving member 6 is provided to move the chuck member 5 toward the rotary bobbin (K), and moving the chuck member 5 toward the replacement bobbin case 2 supplied by the bobbin case providing member 3.

The bobbin case providing member 3 is placed in the periphery end (Ta) of the sewing table (T) so that the sewing workers can access easily. On an underside of the sewing table (T), a rotary axis 7 is rotationally provided. As shown in FIGS. 1 and 2, a pair of bobbin core pins 8, 8 is firmly fixed to the rotary axis 7 via a collar to extend in a diametrically (180°) opposed direction so as to form a case mounting member 9 in which the replacement bobbin case and the consumed bobbin case 2 are to be mounted. A rotary drive device 10 is provided to rotationally reverse the rotary axis 7 by 180 degrees.

A rotary drive device 10 has a pinion 10*a* attached to the rotary axis 7 and having a rack 10*b* which meshes with the pinion 10*a*. An air cylinder 10*c* is provided to reciprocally move the rack 10*b*. The rotary axis 7 coupled with the rotary drive device 10 forms a rotary drive member. With an actuation of the air cylinder 10*c*, it is possible to rotationally move the rotary axis 7 by 180 degrees through the motion of the rack 10*b* and the pinion 10*a*.

One of the bobbin core pins 8, 8 has the replacement bobbin case 2, and the other bobbin core pin 8 is left empty. When the empty bobbin core pin 8 located in the exchangeable position (α) receives the consumed bobbin case 2, the bobbin case providing member 3 actuates the air cylinder 10*c* to rotationally reverse the rotary axis 7 by 180 degrees to supply the replacement bobbin case 2 in the exchangeable position (α). The air cylinder 10*c* is controlled by a control circuit (not shown) so that the case mounting member 9 rotationally moves.

The chuck member 5 is secured to a follower slider 28 (described in detail hereinafter), and has a support plate 12 which holds a cylindrical end of a bobbin case body 11 as shown in FIG. 2. The chuck member 5 further has a pawl 14 which raises a lock lever 13 of the replacement and consumed bobbin case 2. An engagement piece 15 is provided in the manner to sandwich the lock lever 13 with the pawl 14.

The pawl 14 pivotally moves in such a direction as to raise a claw of the lock lever 13 with an actuation of an air cylinder 16, and is released to an original position by a return spring (not shown). When the chuck member 5 removes the consumed bobbin case 2 from the rotary bobbin (K), the pawl 14 pivots to raise the lock lever 13. Once the consumed bobbin case 2 is handed to the empty bobbin core pin 8 of the case mounting member 9, the pawl 14 returns to the original position. Then, the pawl 14 pivots to raise the lock lever 13 again, and returns to the original position when the chuck member 5 hands the replacement bobbin case 2 to the rotary bobbin (K).

In this instance, it is to be noted that the air cylinder 16 is controlled by the control circuit so that the pawl 14 rotationally moves as above.

The chuck driving member 6 mainly constitutes a cam plate 20, neck transfer body 21 and a movement axis drive member 22.

As shown in FIG. 1, the cam plate 20 is firmly placed in a position in which an extension line of the exchangeable position (α) and an extension line of the rotary bobbin (K) meet. The cam plate 20 has a cammed groove 23 oriented toward the exchangeable position (α) and the rotary bobbin (K), and having a regulation groove 24 along the cammed groove 23 but shorter than the cammed groove 23.

The cammed groove 23 has a first linear groove 23*a* oriented toward an axis of the rotary bobbin (K), a second linear groove 23*b* oriented toward the bobbin core pin 8, and having a third groove 23*c* which connects the first linear groove 23*a* and the second linear groove 23*b*.

As shown in FIG. 1, the regulation groove 24 is located substantially at the same level of both the first linear groove 23*a* and the second linear groove 23*b*.

The neck transfer body 21 has a regulation axis 25 movably interfit into the regulation groove 24, and having a regulation slider 26 rotationally supported around the regulation axis 25. The neck transfer body 21 further has a follower slider 28 connected to the regulation slider 26 via rods 27, 27. The follower slider 28 is rockably mounted around the regulation axis 25 within a predetermined angle. To the follower slider 28, the chuck member 5 is secured and a movement axis 29 is attached to reciprocally move along the cammed groove 23.

For the reason that the movement axis 29 interfits into the cammed groove 23, and the regulation axis 25 interfits into the regulation groove 24, the neck transfer body 21 inclines to such a degree as determined by the positional relationship between the regulation axis 25 and the movement axis 29. The neck transfer body 21 slides to such a degree as determined by the movement axis drive member 22.

When the movement axis 29 moves along the cammed groove 23, the follower slider 28 moves along the first, second and third grooves 23*a*, 23*b*, 23*c* so as to incline in accordance with the position in which the regulation axis 25 occupies in the regulation groove 24.

Due to the fact that the regulation groove 24 is shorter than the cammed groove 23, and located substantially at the same level in which the first linear groove 23*a* and the second linear groove 23*b* occupies respectively, when the movement axis 29 approaches the rotary bobbin (K), the follower slider 28 and the chuck member 5 are oriented toward the rotary bobbin (K). Conversely when the movement axis 29 approaches the exchangeable position (α), the follower slider 28 and the chuck member 5 are directed toward the exchangeable position (α).

The movement axis drive member 22 reciprocally moves the movement axis 29 along the cammed groove 23. The movement axis drive member 22 has a slider bar 30 placed in parallel with the cam plate 20, and has a drive slider 31 which is to fit into the movement axis 29 via a drive escape groove 31*a* provided in a direction which the cammed groove 23 develops. A chuck transferal actuator 32 is provided to reciprocally move the drive slider 31 along the slider bar 30.

In this instance, as shown in FIG. 2, the chuck transferal actuator 32 is formed herein by combining a long range air cylinder 32*a* which travels the drive slider 31 in an extended distance, and a short range air cylinder 32*b* which travels the drive slider 31 in a shorter distance. However, instead of the two air cylinders 32*a*, 32*b*, a single lengthened air cylinder may be used.

The long range air cylinder 32*a* and the short range air cylinder 32*b* are commonly connected at their movable rod, and controlled by the control circuit. The long range air cylinder 32*a* is secured to the sewing machine (M), and the short range air cylinder 32*b* moves with the drive slider 31.

[How Remote Control Bobbin Case Exchanger Device Works]

With the long range air cylinder 32*a* retracted inward and the short range air cylinder 32*b* protracted outward, the movement axis 29 is located a little away (approx. 30 mm) from the end of the first linear groove 23*a* so that the chuck member 5 waits at the position somewhat far from the rotary bobbin (K).

In this situation, when the control circuit receives a manual signal from the sewing worker or receiving an electronic signal from an automatic under thread exchanger, the remote control bobbin case exchanger device 1 is activated. This retracts the short range air cylinder 32*b* to move the movement axis 29 to one end of the first linear groove 23*a* so that the chuck member 5 moves to clutch the consumed bobbin case 2.

When the chuck member 5 clutches the consumed bobbin case 2, the long range air cylinder 32*a* and the short range air cylinder 32*b* protracts outward respectively to move the movement axis 29 to one end of the second linear groove 23*b*. This movement rotationally reverses the neck transfer body 21 around the regulation axis 25 by 180 degrees so that the chuck member 5 hands the consumed bobbin case 2 over the empty bobbin core pin 8 which occupies the exchangeable position (α).

Once the chuck member 5 releases the consumed bobbin case 2, the short range air cylinder 32*b* retracts inward. Then, the movement axis 29 moves a little away (approx. 20 mm) from the end of the second linear groove 23*b* while making the chuck member 5 wait at the position a little away from the case mounting member 9 during the time which the case mounting member 9 rotationally moves in the reverse direction.

In combination with the reverse movement of the case mounting member 9, the replacement bobbin case 2 is sent to the exchangeable position (α) to protract the short range air cylinder 32*b* outward. This moves the movement axis 29 to the end of the second linear groove 23*b* again so that the chuck member 5 moves to the exchangeable position (α) so as to clutch the replacement bobbin case 2.

When the chuck member 5 clutches the replacement bobbin case 2, the long range air cylinder 32*a* and the short range air cylinder 32*b* retracts inward respectively so as to move the movement axis 29 to the end of the first linear groove 23*a*. This movement rotationally reverses the neck transfer body 21 around the regulation axis 25 by 180 degrees so that the chuck member 5 moves toward the rotary bobbin (K) to set the replacement bobbin case 2 within the rotary bobbin (K).

When the chuck member 5 releases the replacement bobbin case 2 within the rotary bobbin (K), the short range air cylinder 32*b* protracts outward. Then, the movement axis 29 returns to the original position in which the movement axis 29 is a little away from the end of the first linear groove 23*a* while the chuck member 5 waits a little away from the rotary bobbin (K).

With the actions described above, it is possible to replace the consumed bobbin case with the replacement bobbin case upon resuming the sewing operation.

It is further possible to save the loss of time by having beforehand replaced the consumed bobbin case on the case mounting member 9 with the replacement bobbin case.

[Advantages]

With the use of the remote control bobbin case exchanger device 1, it is possible to readily exchange the bobbin case by a new one because the bobbin case providing member is placed in the accessible position under the circumstances in which the rotary bobbin (K) is inaccessibley placed. This reduces the burdens to which the sewing workers have usually owed, and significantly reduces the time required to exchange the under thread with the ameliorated workability.

This is all the more true especially in the industrial sewing machine (M) in which a plurality of embroideries are concurrently wrought out. By mounting the remote control bobbin case exchanger devices on the respective rotary bobbins, it is possible to exchange the plurality of the bobbin cases 2 simultaneously, and thereby substantially ameliorating a sewing workability upon exchanging the bobbin cases 2.

With the use of the long range air cylinder 32*a* and the short range air cylinder 32*b* combined as the chuck transferal actuator 32, it is possible to reduce their travel distances. This makes it possible to dispense with the concomitant plays of the chuck member 5, and thereby exchanging the consumed bobbin case 2 with the replacement bobbin case for a short period of time with a good workability.

[Modification Form]

It is to be observed that hydraulic cylinders and a servomotor can be used instead of the air cylinders 10*c*, 16, 32*a*, 32*b* used in the embodiment of the invention.

It is also to be noted that motion of the sewing machine (M) may be utilized via a gear train or belts to move the component parts which the air cylinders 10*c*, 16, 32*a*, 32*b* otherwise would have to actuate.

What is claimed is:

1. A remote control bobbin case exchanger device comprising:

(a) a bobbin case providing member (3) placed remote from a rotary bobbin (K) of a sewing machine (M) so as to provide a bobbin case (2) in an exchangeable position (α);

(b) a chuck member (5) provided to exchange the bobbin case (2);

(c) a chuck driving member (6) provided to transfer the chuck member (5) toward the rotary bobbin (K) and the exchangeable position (α);

(d) the chuck driving member (6) including;

(i) a cam plate (20) having a cammed groove (23) directed to the rotary bobbin (K) and having a regulation groove (24) provided along the cammed groove (23) and determined over its trajectory so as to be shorter than the cammed groove (23);

(ii) a neck transfer body (21) having a regulation slider (26) rotationally supported around a regulation axis (25) which is movably provided along the regulation groove (24), and a follower slider (28) having a movement axis (29) slidably provided against the regulation slider (26) within a predetermined range to move along the cammed groove (23); and (iii) a movement axis drive member (22) provided to reciprocally drive the movement axis (29) along the cammed groove (23).

2. A remote control bobbin case exchanger device as set forth in claim 1, wherein the movement axis drive member (22) comprises;

a slider bar (30) provided in parallel with the cam plate (20);

a drive slider (31) movably provided along the slider bar (30) to interfit the movement axis (29) via a drive escape groove (31*a*) oriented in the same direction in which the cammed groove (23) develops; and a chuck transferal actuator (32) provided to reciprocally move the drive slider (31) along the slider bar (30).

3. A remote control bobbin case exchanger device as set forth in claim 2, wherein the chuck transferal actuator (32) comprises a combination of;

a long range air cylinder (32*a*) provided to travel the drive slider (31) in an extended distance; and a short range air cylinder (32*b*) provided to travel the drive slider (31) in a shorter distance.

4. A remote control bobbin case exchanger device as set forth in any one of claims 1~3, wherein the bobbin case providing member (3) comprises a case mounting member (9), an outside of which has a plurality of bobbin cases (2) removably mounted thereon; and a rotary drive member (10) provided to rotationally drive the case mounting member (9).

* * * * *